US007111400B2

(12) United States Patent
Guimont et al.

(10) Patent No.: US 7,111,400 B2
(45) Date of Patent: Sep. 26, 2006

(54) RAZOR HAVING THERMO-ELECTRIC SHAVING AID EJECTION SYSTEM AND METHOD OF EJECTING SHAVING AID

(75) Inventors: Raymond Guimont, Guilford, CT (US); Matthew Swanson, Mill Creek, WA (US); Hao-Chih Liu, Stanford, CA (US); Ye Tao, Stanford, CA (US)

(73) Assignee: Eveready Battery Company, Inc., St. Louis, MO (US)

( * ) Notice: Subject to any disclaimer, the term of this patent is extended or adjusted under 35 U.S.C. 154(b) by 0 days.

(21) Appl. No.: 10/351,680

(22) Filed: Jan. 27, 2003

(65) Prior Publication Data

US 2003/0154832 A1 Aug. 21, 2003

Related U.S. Application Data

(60) Provisional application No. 60/352,804, filed on Jan. 30, 2002.

(51) Int. Cl.
*B26B 21/00* (2006.01)

(52) U.S. Cl. ..... 30/41; 30/50

(58) Field of Classification Search ..... 30/41, 30/140, 41.5

See application file for complete search history.

(56) References Cited

U.S. PATENT DOCUMENTS

| | | | | | |
|---|---|---|---|---|---|
| 2,120,940 | A | * | 6/1938 | Minassian | 30/41 |
| 2,225,257 | A | * | 12/1940 | Conill | 30/34.05 |
| 2,336,806 | A | * | 12/1943 | Schenk et al. | 30/41 |
| 2,715,767 | A | * | 8/1955 | Van Heest | 30/41 |
| 2,824,566 | A | * | 2/1958 | Pileggi | 132/213 |
| 3,252,217 | A | * | 5/1966 | Werft | 30/41 |
| 3,364,568 | A | * | 1/1968 | Lowy | 30/34.05 |
| 4,228,586 | A | * | 10/1980 | Thierry | 30/41 |
| 4,238,882 | A | * | 12/1980 | Harrison, Sr. | 30/41 |
| 4,399,349 | A | * | 8/1983 | Deming et al. | 392/403 |
| 4,850,107 | A | * | 7/1989 | Valliades et al. | 30/41 |
| 5,036,587 | A | * | 8/1991 | Trotta et al. | 30/41 |
| 5,072,512 | A | | 12/1991 | Noujain | |
| 5,121,541 | A | * | 6/1992 | Patrakis | 30/41 |
| 5,384,961 | A | * | 1/1995 | Gregory | 30/41.5 |
| 5,394,777 | A | * | 3/1995 | Kozikowski | 83/15 |
| 5,653,025 | A | * | 8/1997 | Cheng et al. | 30/41 |
| RE38,634 | E | * | 10/2004 | Westerhof et al. | 30/41 |
| 2001/0015016 | A1 | * | 8/2001 | Pragt | 30/34.2 |

FOREIGN PATENT DOCUMENTS

| | | |
|---|---|---|
| DE | 718879 | 2/1942 |
| FR | 2 703 290 | 10/1994 |
| FR | 2703290 | * 10/1994 |
| WO | WO 94/04106 | 3/1994 |

* cited by examiner

*Primary Examiner*—Kenneth E. Peterson
(74) *Attorney, Agent, or Firm*—Michaud-Duffy Group LLP

(57) ABSTRACT

A shaving aid delivery system for a shaving system includes a razor head having a reservoir for holding a shaving aid and a heating apparatus disposed adjacent the reservoir. The delivery system also includes a shaving strip disposed within the razor head, an actuator and an ejection port. The shaving strip is oriented to engage the skin of a user during a shaving stroke and the actuator electrically couples to the heating apparatus to cause volumetric expansion of the shaving aid when activated. The ejection port directs the shaving aid from the reservoir onto the shaving strip upon activation of the actuator.

9 Claims, 6 Drawing Sheets

RAZOR HAVING THERMO-ELECTRIC SHAVING AID EJECTION SYSTEM AND METHOD OF EJECTING SHAVING AID

CROSS REFERENCE TO RELATED APPLICATIONS

This application claims benefit under Title 35 U.S.C. § 119(e) of U.S. Provisional Application Ser. No. 60/352,804 filed Jan. 30, 2002, the disclosure of which is herein incorporated by reference.

BACKGROUND

The present disclosure relates to a shaving system having a lubricating shaving aid for improving the ease with which a razor can be drawn across the skin during the shaving process. More particularly, the present disclosure relates to a shaving system which utilizes a thermo-electric system for selectively ejecting shaving aid on demand.

FIELD OF THE DISCLOSURE

It is known that many factors contribute to overall discomfort during the shaving process. Such factors may include excessive frictional drag of the razor across the skin and the inflammation of various known epidermal conditions which may become irritated by the shaving process, e.g., psoriasis, eczema, erythema, skin rashes, acne, etc. Efforts to address some of these factors have led to the use of emollients such as, for example, pre-shave and/or after-shave lotions, beard softening agents, lathering emollients, medicinal or soothing ointments, aloes, foams, soaps, etc. Even though shaving comfort may be enhanced to some degree utilizing one or more of the above emollients, the requirement that they be applied before or after shaving tends to decrease their overall effectiveness and simply adds to the complexity and time consuming process of shaving.

It is also known that shaving systems themselves may be significantly enhanced by utilizing a shaving aid to lubricate the skin engaging surfaces during the shaving process. For example, static lubricating shaving aids integrated with or attached to the shaving instrument typically adjacent the blade(s) are known to substantially reduce the frictional drag of the skin engaging elements as the shaving instrument is drawn across the shaver's skin. Typically, these shaving aids are manufactured as lubricating strips which are affixed to the razor head proximate the razor cap portion. The lubricating strips generally include a water-insoluble polymer-like material, e.g., polystyrene, and a water-soluble shaving aid emollient, e.g., polyethylene oxide, which tends to leach from the strip during shaving to enhance shave comfort by reducing friction. Unfortunately, conventional shaving aid strips tend to release an unbalanced quantity of shaving aid over time. Initially, a great quantity will leach from the strip while, after repeated use, progressively smaller quantities are released. Moreover, the surface of the strip may become irregular and rough after repeated use thereby increasing the coefficient of friction of the strip which may contribute to further skin irritation.

As a result, several manufacturers have attempted to develop new systems associated with the delivery of shaving aids to enhance and prolong the release of the shaving aid during the initial shaving process and over the course of several shaves. Other efforts have been directed at providing delivery systems which consistently apply the appropriate amount of shaving aid over repeated shavings. However and by and large, many of these efforts have been only partially successful in their ability to consistently provide shaving aid over repeated shaving cycles to maintain a consistent and acceptable level of comfort during the shaving process.

Accordingly, there exists a need to develop a simple and effective shaving system which incorporates a system for effectively delivering a desired amount of shaving aid automatically or selectively by a user over the course of the normal and expected life of the razor or razor cartridge.

SUMMARY

The present disclosure relates to a shaving aid delivery system for a shaving system which includes a razor head having a reservoir for holding a shaving aid and a heating apparatus disposed adjacent the reservoir preferably in contact with the shaving aid. The delivery system also includes a shaving strip disposed within the razor head and an actuator which electrically couples to the heating element to cause volumetric expansion of the shaving aid when activated. Preferably, the shaving strip is made from a low friction absorbent foam-like material and is oriented to engage the skin of a user during a shaving stroke. The delivery system also includes an ejection port for directing the shaving aid from the reservoir into contact with the shaving strip upon activation of the actuator. Alternatively, the shaving strip could also be made from a porous or permeable membrane with a unidirectional flow which engages the skin of the user during shaving.

In one embodiment of the present disclosure, the razor head is selectively engageable with and detachable from a razor handle, i.e., a disposable razor head cartridge. In another embodiment, the razor head is integral with the razor handle and the entire razor is disposable after a recommended number of shaves. Preferably, the actuator is affixed to the razor handle such that selective activation of the actuator dispenses shaving aid from the reservoir to the shaving strip as needed during the shaving process.

In another embodiment according to the present disclosure, a plurality of ejection ports are disposed across the razor head and each ejection port directs shaving aid from the reservoir onto the shaving strip upon activation of the actuator. In yet another embodiment, the delivery system includes a plurality of reservoirs each having an ejection port for dispersing shaving aid along the length of the shaving strip. Alternatively, the shaving strip may be segmented such that each strip segment aligns with one or more corresponding ejection port(s) to receive shaving aid upon selective actuation by the user.

In another embodiment, each reservoir contains one or more shaving aids (or different shaving aids) selected from the group consisting of: silicone oils, Aloe Vera compounds, moisturizers, medicinal agents, cosmetic agents, essential oils, vitamin oils, lubricants, sunflower oils, sodium pyruvates, polyethylene oxides, non-ionic polyacrylamides, polysaccharides, sodium lauryl sulphates, polystyrene compounds and polypropylene compounds. More specific examples include: synthetic shaving aids such as Dimenthicone, C12–C15 Alcohol Benzoates, Glycerin, Cety Alcohol and Steryl Alcohol and natural shaving aids such as Jojoba oil, Allantoin, and Sesame oil.

Another embodiment according to the present disclosure includes a shaving aid delivery system for a shaving system which includes a razor head having a plurality of reservoirs for holding a shaving aid and a heating apparatus which includes at least one resistor and an electrical source. Preferably, a resistor is disposed within each of the reservoirs and in contact with the shaving aid. Each of the resistors is electrically coupled to a corresponding actuator which causes volumetric expansion of the shaving aid within each of the corresponding reservoirs when activated. A shaving strip is disposed within the razor head and oriented to engage the skin of a user during a shaving stroke.

Preferably, the shaving strip is positioned relative to each of the reservoirs and the ejection port disposed within each of the reservoirs directs shaving aid from the reservoir onto the shaving strip upon activation of the actuator corresponding to each reservoir. Alternatively, one of the plurality of the reservoirs includes a first shaving aid and another of the plurality of reservoirs includes a second shaving aid wherein each of the first and second shaving aids is selected from the above-identified group of oils, agents and compounds. Preferably, each of the actuators is selectively and independently activatable by the user to direct shaving aid from each of the corresponding reservoirs onto the shaving strip as needed during the shaving process.

The present disclosure also relates to a method of ejecting shaving aid from a razor head and includes the steps of: providing a razor head having: a reservoir for holding a shaving aid; a heating element, e.g., resistor, disposed within the reservoir; a shaving strip disposed within the razor head and oriented to engage the skin of a user during a shaving stroke; and an ejection port for directing the shaving aid from the reservoir into contact with the shaving strip. The method also includes the step of selectively activating the resistor to cause rapid volumetric expansion of the shaving aid such that the shaving aid disperses from the ejection port onto the shaving strip.

BRIEF DESCRIPTION OF THE DRAWINGS

Other objects and features of the present disclosure will become apparent from the following detailed description considered in connection with the accompanied drawings. It should be understood, however, that the drawings are designed for the purpose of illustration only and not as a definition of the limits of the present disclosure.

An illustrative embodiment of the subject thermo-electric shaving aid ejection system and method are described herein with reference to the drawings wherein.

DETAILED DESCRIPTION OF THE PREFERRED EMBODIMENTS

Figure 1:
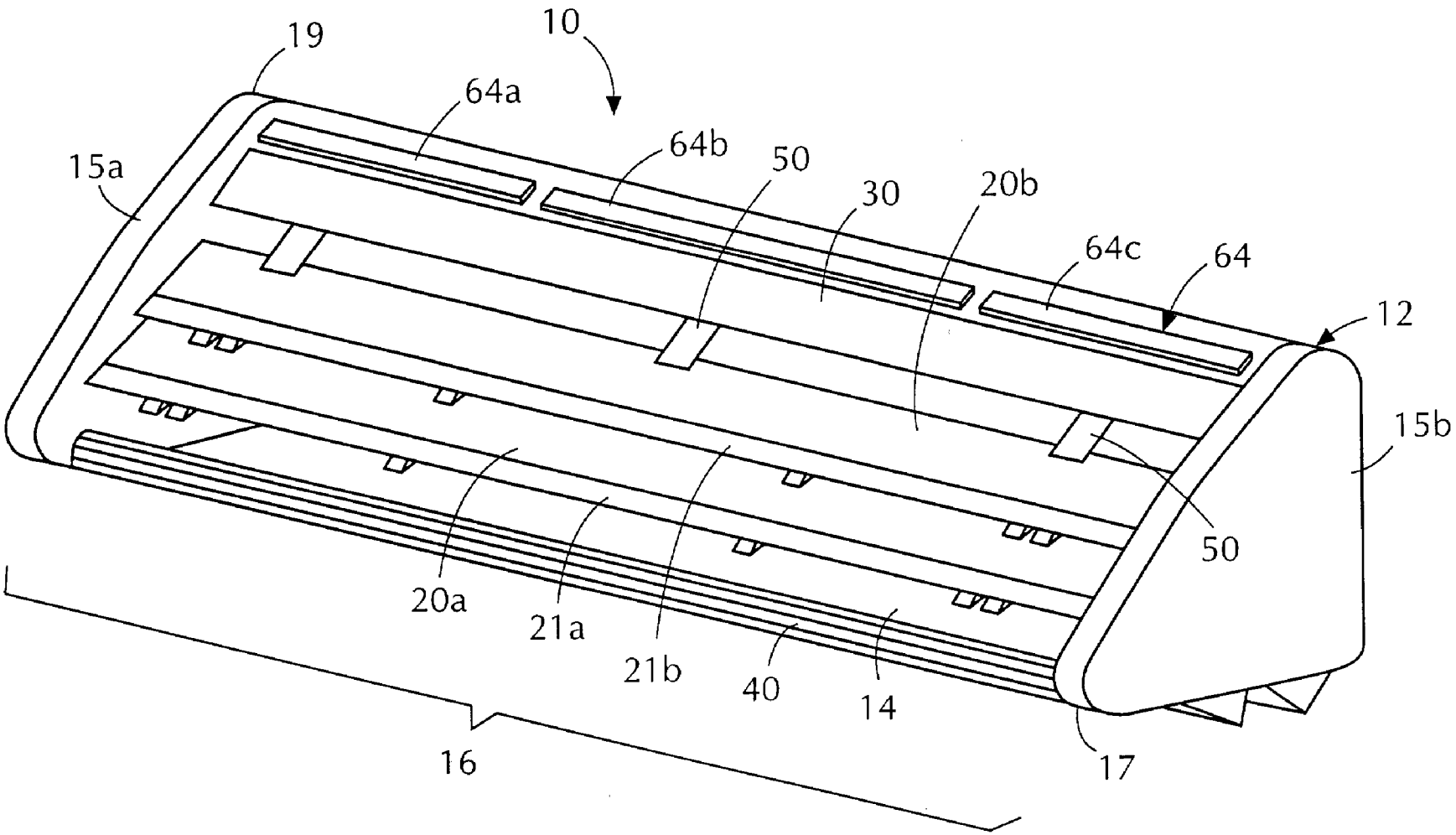
FIG. 1 is a perspective view of a razor cartridge for a shaving system.

Referring now to FIGS. 1–3A, one embodiment of a shaving aid delivery system is shown for use prior to and/or during the shaving process and is generally identified by reference numeral 60. The shaving aid delivery system 60 may be incorporated with the various known types of disposable razors in which the razor (or the useable portion thereof, e.g., a razor head cartridge) is disposed and replaced after a select number of shaves.

Figure 2A:
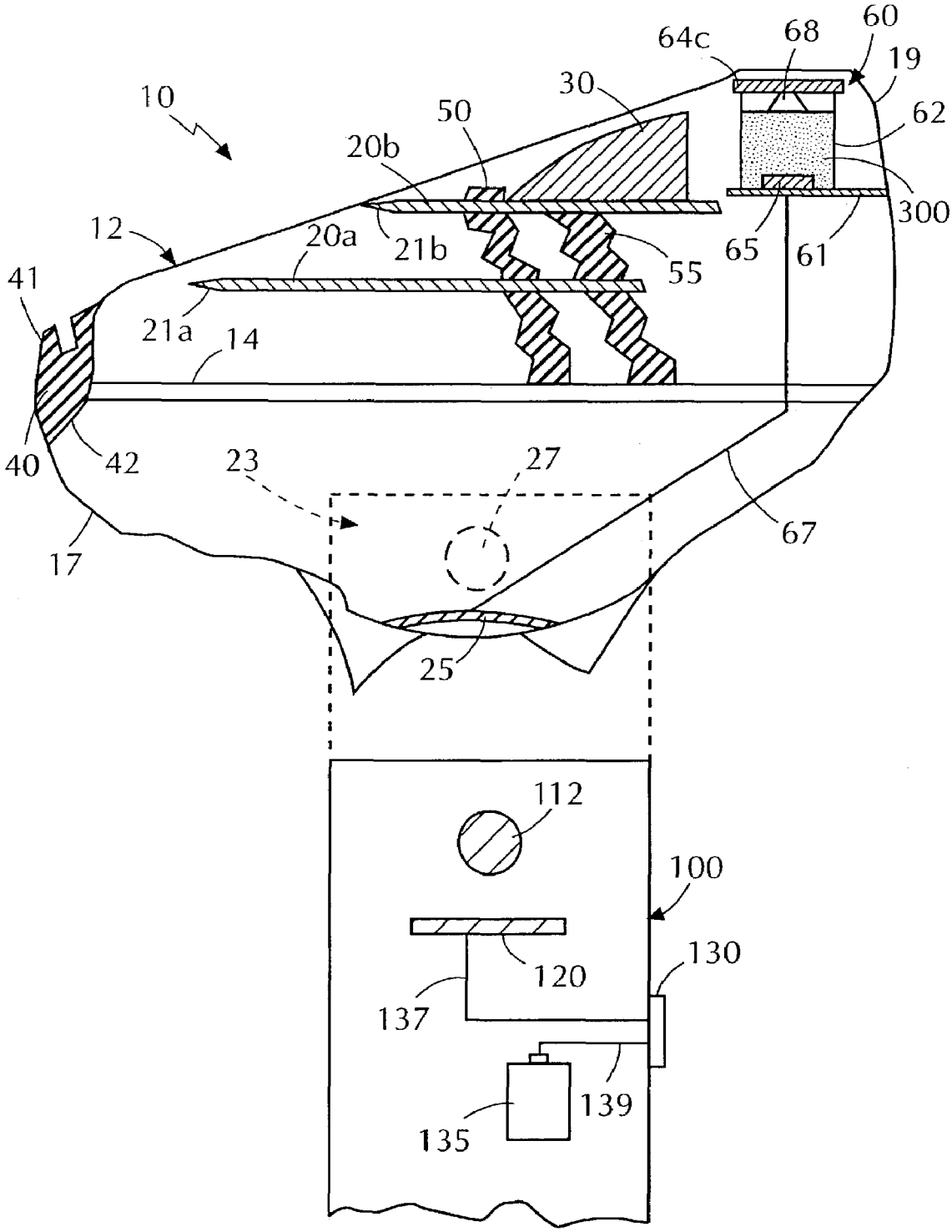
FIG. 2A is an enlarged, side cross-sectional view of the razor cartridge of FIG. 1 having a shaving aid delivery system according to the present disclosure.
Figure 2B:
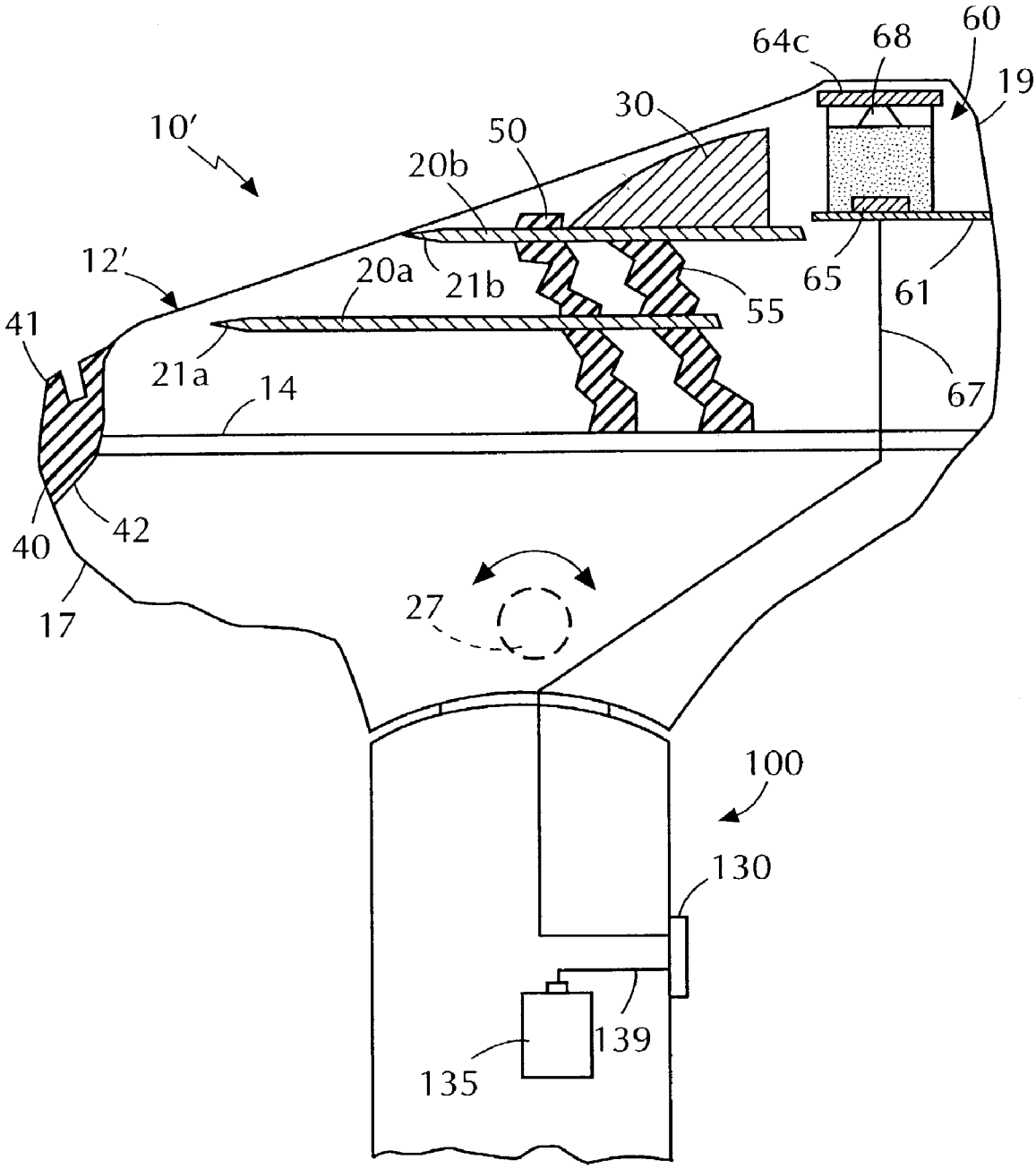
FIG. 2B is an enlarged, side cross-sectional view of another embodiment of the shaving aid delivery system wherein the razor cartridge is integrally associated with a razor handle.

The embodiment of the present disclosure illustrated in FIGS. 1 and 2A show a shaving system 10 in the form of a razor head cartridge 12 which includes a support base 14 having resilient supports 50 and 55 which movably connect a pair of sharpened blades 20*a* and 20*b* and a cap member 30 to the support base 14. Although FIGS. 1 and 2 show a shaving system 10 with a disposable cartridge 12, the advantages of the present disclosure are equally applicable to other razor designs and shaving systems, e.g., shaving system 10' (see FIG. 2B). As used herein, the term "razor head" is meant to include cartridges 12 which are designed and manufactured for attachment to a separate razor handle 100, as well as a disposable razor wherein the skin-engaging portions (i.e., guard bar, blades, cap and lubricating shaving strip) are integrally formed with a razor handle section 100. Moreover, although the shaving systems disclosed herein generally relate to facial shaving systems, it is contemplated that the presently-disclosed shaving aid delivery system may be included with other known shaving systems which engage other skin areas, e.g., legs, arms, surgical areas, etc.

The razor head 12, 12' illustrated in FIGS. 1, 2A and 2B includes a support base 14 defined by forward and rear surfaces 17 and 19, respectively, and fixed side walls 15*a* and 15*b*. A skin engaging guard member 40 is affixed to the support base 14 along and proximate the forward surface 17 of base 14 and a shaving strip 64 is disposed along the rear surface 19 of base 14. A seat blade 20*a* and a cap blade 20*b* are supported by a plurality of resilient support members 50 and 55 as best shown in FIGS. 2A and 2B. The tip of each blade 20*a* and 20*b* includes a cutting edge 21*a* and 21*b*, respectively, which refers to the area within about 1 mm. from the ultimate tip of each blade 20*a*, 20*b*.

Preferably, the razor blade cutting edges 21*a* and 21*b* are coated with a thin layer of metal coating that provides enhanced durability and corrosion resistance to the underlying metal, e.g., chromium or a chromium/platinum alloy. Other materials may also be coated on a razor blade(s) 20*a*, 20*b* such as, for example, the various coating materials identified in U.S. Pat. No. 5,630,275 which is hereby incorporated in its entirety by reference herein.

It is envisioned that the support members 50 and 55 are attached along base 14 and support each blade 20*a* and 20*b*. The guard member 40, blades 20*a* and 20*b*, cap member 30, lubricating strip 64 and the outward facing surfaces of the side walls 15*a* and 15*b* together define the face 16 of the razor head 12 (12'). These elements are commonly referred to hereafter as "skin engaging elements".

Preferably, a plurality of resilient supports 50 and 55 are disposed at various positions along the face 16 of the razor head 12 (12') to increase the stability of the blades 20*a* and 20*b* and also to provide greater flexibility. It is envisioned that the support members 50 and 55 are designed to have sufficient inherent resiliency to allow the blades 20*a* and 20*b* and cap member 30 to move downwardly relative to side walls 15*a* and 15*b*, i.e. toward base 14, in response to the normal forces encountered during shaving. Preferably, the resilient support members 50 and 55 are manufactured from the same resilient material, however, it is contemplated that the support members 50 and 55 may be manufactured from different resilient materials having varying resiliencies. The length and positioning of the resilient support members 50 and 55 may be also modified to increase or decrease the overall aggressiveness of the shaving geometry in response to forces encountered during shaving. For example, if the length of one resilient support, e.g., 55, is shorter than another resilient support, e.g., 50, the overall shaving angle which directly correlates to the aggressiveness of the shave will change in response to normal shaving forces.

The guard member 40 includes a rear surface 42 which affixes the guard member 40 to the base 14 and an outermost guard surface 41 which is preferably made from a resilient, skin-engaging material having a higher coefficient of friction with wet skin than a rigid plastic of the type commonly used with many disposable cartridges 12. The guard surface 41 is preferably designed to limit the degree to which the razor can be pressed into the skin which protects the skin from cuts and nicks.

The guard member 40 may be either a single unitary piece or separate segments, as set forth in commonly-owned U.S. Pat. Nos. 5,689,883 and 5,475,923 which are both hereby incorporated in their entirety by reference herein. Preferably, the resilient guard surface 41 is formed from one or more materials made from polypropylene, Hercuprene 1000, 3000 series, Durometer 30 to 90 A scale available from J-Von, Leominster, Mass.; Kraton G series, Durometer 30 to 90 A scale available from Shell Chemical Co., Lisle, Ill.; and Santoprene 2271 series, Durometer 30 to 90 A scale available from Monsanto, Colo.

It is contemplated that one or more of the above-identified resilient materials may also be disposed on the upper, skin-engaging portions of sidewalls 15*a* and 15*b*. As can be appreciated, the higher coefficient of friction of the resilient material enables the guard member 40 (and the sidewalls 15*a*, 15*b*) to grip the skin and exert greater control of the skin as it flows over the blade(s) 20*a*, 20*b*. Moreover, the resilient material provides a more detectable sensation to the skin in a manner which will tend to mask any unpleasant sensory perceptions of a sharpened blade traveling across the skin.

Cap member 30 seats atop blade 20*b*. The cap member 30 may be formed as a single piece extending across the face 16 of the razor head 12, 12' or the cap member may be segmented into a plurality of individual segments depending upon a particular purpose. It is contemplated that the cap member 30 may be integrally formed with or affixed to one or more of the resilient supports 50, 55 in order to unify the overall movement of the blades 20*a*, 20*b* and the cap member 30 across the skin during a shaving stroke. Other advantages relating to the formation of the cap member 30 are described in commonly-owned U.S. Pat. Nos. 5,822,862, 5,666,729 and 5,456,009 which are all hereby incorporated by reference in their entirety herein.

As best illustrated in FIGS. 2A and 2B, the shaving system 10 (10') includes a shaving aid delivery system 60 according to the present disclosure which is disposed within the razor head 12 (12') for selectively delivering shaving aid 300 either prior to and/or during the shaving process. More particularly, the shaving aid delivery system 60 includes a reservoir/container 62 for storing a predetermined amount of shaving aid 300 for dispersal and a lubricating strip 64 disposed atop the reservoir 62 which engages the skin during the shaving stroke. Preferably, a sill or ledge 61 supports the reservoir 62 within the razor head 12 (12'), however, other means for supporting the reservoir 62 are also contemplated, e.g., brackets, pins, tabs, etc.

Generally, the reservoir 62 includes a heating element, e.g., resistor 65, disposed therein which is electrically coupled to an electrical source 135, e.g., battery, through an actuator or switch 130. For the purposes herein, the term "heating apparatus" includes the heating element 65 and an electrical source, e.g., battery 135. Preferably, switch 130 is disposed on the razor handle 100 to enable the user to easily and selectively dispense shaving aid 300 from reservoir 62 as needed prior to and/or during the shaving process. The reservoir 62 also includes an ejector or nozzle 68 which issues shaving aid 300 from the reservoir 62 onto the lubricating shaving strip or pad 64 as described in more detail below with respect to FIGS. 3A–3C. Preferably, the nozzle 68 is tapered to facilitate distribution of the shaving aid 300 in a droplet-like form atop the shaving strip 64. Alternatively, the nozzle 68 may be dimensioned to issue the shaving aid in a spray-like manner. The shaving strip 64 is disposed proximate the rear surface 19 of the razor head 10 (10') and is oriented to engage the skin surface during a normal shaving stroke. It is envisioned that the shaving strip 64 may be formed of unitary construction (see FIG. 3B) or segmented (see FIGS. 1, 3A and 3C).

It is also envisioned that the shaving system could be designed such that the shaving aid 300 is dispersed automatically prior to engagement of the razor 12 with the skin of the user and/or during engagement of the razor with the skin. For example, the actuator or switch 130 could be automatically activated on facial contact and/or on a change in temperature (hot water).

FIG. 2A shows one embodiment of the delivery system 60 which is designed for use with a disposable razor head 12 (i.e., commonly referred to as a "razor cartridge") which selectively engages a permanent razor handle 100. It is envisioned that the razor head 12 may engage the razor handle 100 utilizing a variety of different engagement mechanisms and techniques known in the art such as, for example, the mechanisms and techniques described with respect to commonly-owned U.S. Pat. Nos. 6,182,366, 6,138,361, 6,122,826, 6,112,412, 6,026,577, 5,953,824, 5,787,593 and 5,333,383 which are all hereby incorporated by reference in their entirety herein.

With particular respect to the embodiment shown in FIG. 2A, the handle 100 (or at least a portion thereof) is dimensioned to engage a corresponding cavity 23 disposed within the razor head 12. The razor head 12 includes a notch 27 disposed therein which is dimensioned to selectively engage a pin 112 projecting from the razor handle 100. Preferably, the pin 112 and notch 27 interface allows the razor head 12 to pivot in response to the normal forces encountered during shaving.

An electrical contact 25 is also disposed within the razor head 12 which is designed to electronically interface with a corresponding contact 120 disposed with the handle upon engagement of the razor head 12 atop the handle 100. An electrical cable 67 (or the like) may be employed to connect the contact 25 with the heating element 65. Similarly, additional cables 137 and 139 may be employed to electrically connect contact 120 to the electrical source 135 through the switch 130. As can be appreciated, the contacts 25 and 120 (and electrical cables 139, 137 and 67) provide electrical continuity from the electrical source 135 to the heating element 65 upon activation of the switch 130.

When switch 130 is activated, the heating element 65 is quickly heated thereby transferring a significant amount of energy to the shaving aid 300. As a result, a small portion of the shaving aid 300 is quickly vaporized which produces a bubble 400 in the reservoir 62. As the bubble expands, a pressure wave(s) "A" is created which forces a droplet of shaving aid 300 from the nozzle 68 and onto the shaving strip 64. By controlling the energy transfer to the shaving aid 300, the bubble 400 quickly collapses before any shaving aid vapor can escape nozzle 68. It is envisioned that a control circuit (not shown) may be included with the switch 130 to control the overall release of shaving aid during activation.

As can be appreciated with this particular embodiment, when the shaving aid 300 is depleted after a specific number of shaves, the user simple replaces the razor head 12 with a new razor head which includes a replenished reservoir of shaving aid 300. Alternatively, the shaving system 60 may be designed such that the user may selectively change and/or replenish one or more reservoirs 62 at any time irrespective of the wear on the razor head 12. As mentioned below, the reservoirs 62 may include a separate orifice or inlet (not shown) which allows a user to inject new shaving aid 300 into a specific reservoir as needed during the life of the razor head 12.

FIG. 2B shows another embodiment of the delivery system 60 disposed within a shaving system 10' wherein the entire shaving system 10' is disposable. This embodiment incorporates many of the same features of the shaving system 10 with the exception that the razor head 12' is integral with the razor handle 100. Similar shaving systems are described U.S. Pat. Nos. 5,678,316 and 5,575,068 which are both hereby incorporated by reference in their entirety herein.

As used herein, the term "shaving aid 300" refers to a large variety of known shave-aiding agents which comprise one or more combinations of the following substances:

- A lubricating agent for reducing the frictional forces between the razor and the skin, e.g., a silicone oil;
- An agent which reduces the drag between the razor parts and the surface being shaved, e.g., a polyethylene oxide in the range of molecular weight between 100,000 and 6,000,000; a non-ionic polyacrylamide; and/or a natural polysaccharide derived from plant materials such as "guar gum";
- An agent which modifies the chemical structure of the hair to allow the razor blade to pass through the whiskers very easily, e.g., a depilatory agent;
- A cleaning agent which allows the whisker and skin debris to wash more easily from the razor parts during shaving, e.g., a silicone polyethylene oxide block copolymer and detergent such as sodium lauryl sulphate;
- A medicinal agent for killing bacteria, or repairing skin damage and abrasions;
- A cosmetic agent for softening, smoothing, conditioning or improving the skin;
- A blood coagulant for the suppression of bleeding that occurs from nicks and cuts;
- Essential oils;
- Vitamin E, e.g., in a formulation of vitamin E acetate, sodium pyruvate, and sunflower oil, contained on a polytrap bead carrier;
- Synthetic moisturizers, lubricants, emollients, e.g., Dimenthicone, C12–C15 Alcohol Benzoates, Glycerin, Cety Alcohol and Steryl Alcohol;
- Natural moisturizers, lubricants, emollients, e.g., Jojoba oil, Allantoin, Aloe Vera and Sesame oil.

Figure 3A:
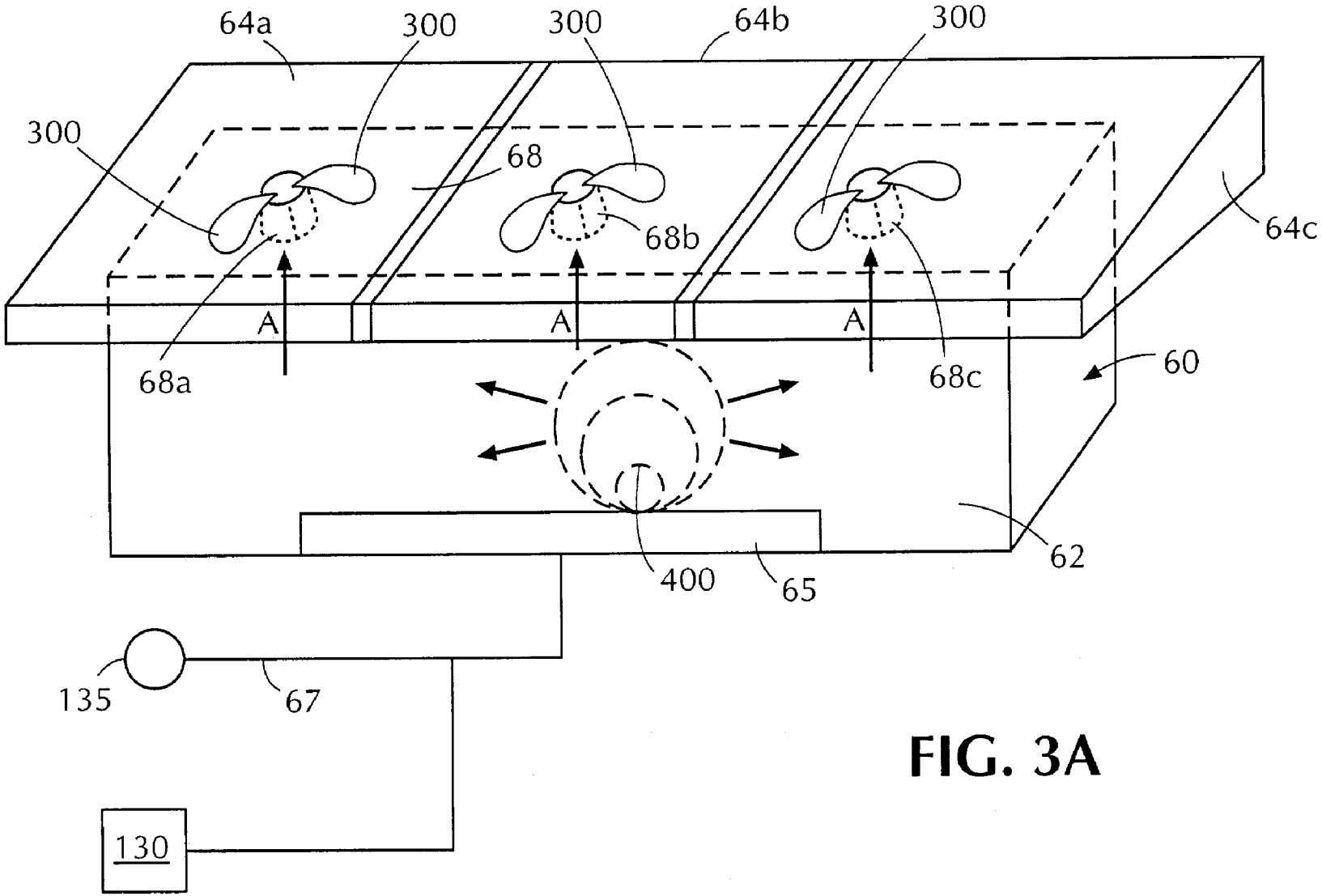
FIG. 3A is a schematic, perspective view of the shaving aid delivery system according to the present disclosure showing shaving aid being issued from a nozzle/orifice as a result of a pressure wave induced by a thermally-excited bubble shown in phantom representation.
Figure 3B:
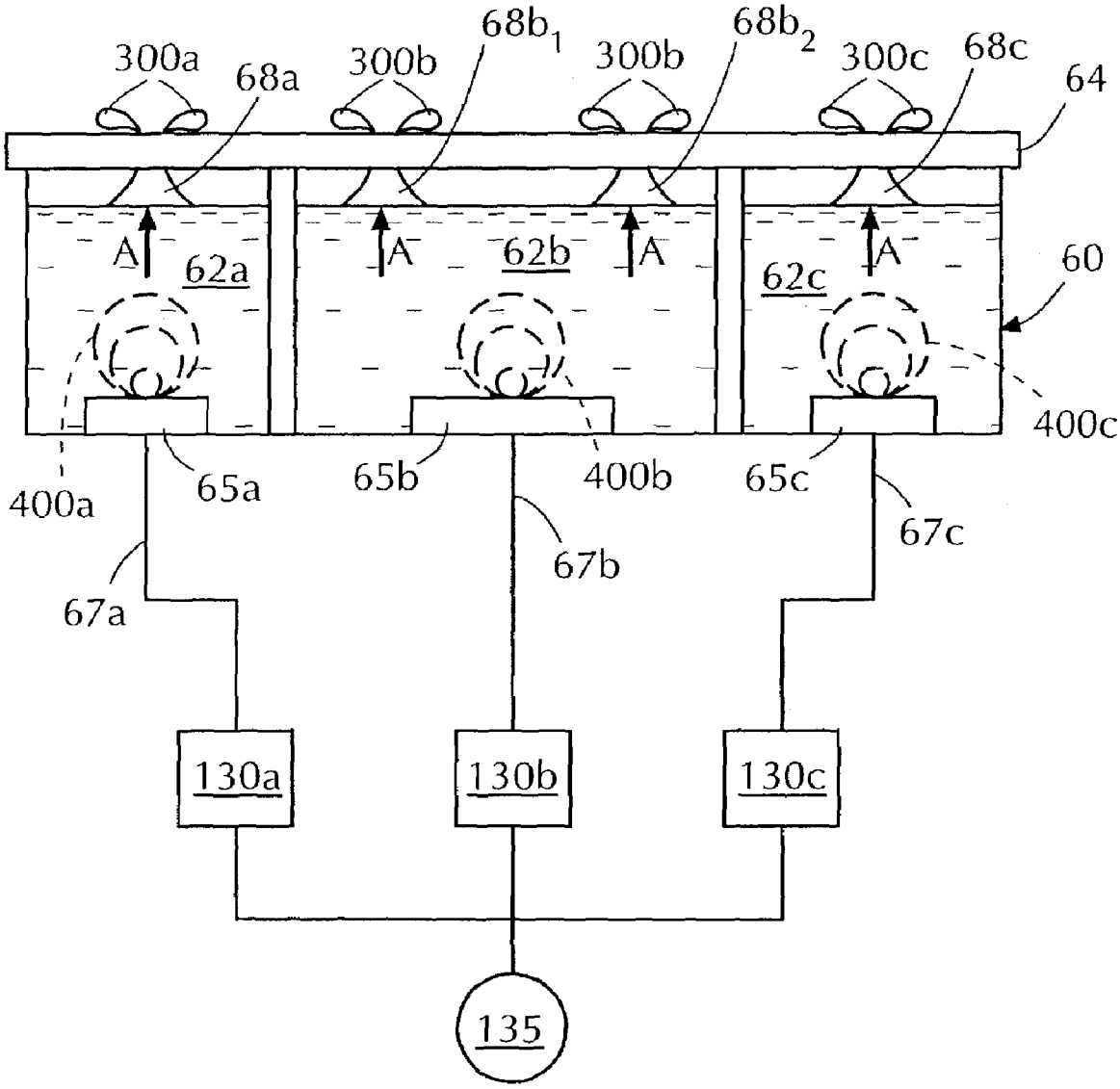
FIG. 3B is a schematic, side view of another embodiment of the shaving aid delivery system having three reservoirs filled with different shaving aids.
Figure 3C:
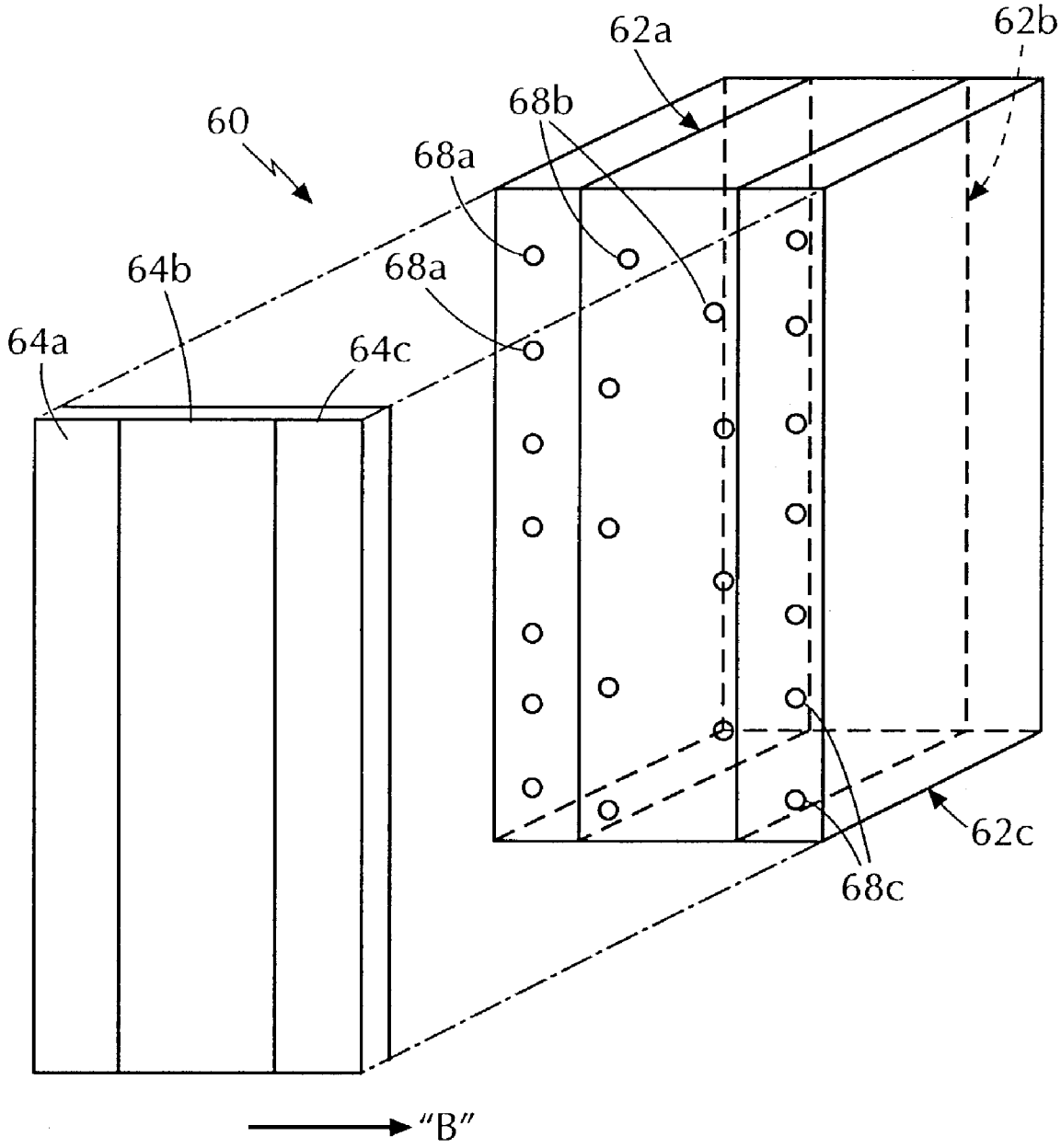
FIG. 3C is an enlarged, schematic view of another embodiment of the shaving aid delivery system having three reservoirs filled with different shaving aids wherein the reservoirs are dimensioned to dispense shaving aid uniformly across the razor head cartridge.

As best shown in FIGS. 3A–3C, a plurality of reservoirs may be included in the shaving aid delivery system 60 to enable the user to selectively delivery different shaving aids 300 from specific reservoirs upon demand. More particularly, the shaving system 60 may include a series of reservoirs 62*a*, 62*b* and 62*c* which include a common heating element 65 (see FIG. 3A) or a plurality of individual heating elements 65*a*, 65*b*, 65*c* (see FIG. 3B) to issue the shaving aid 300 on demand. As can be appreciated, each heating element, e.g., 65*a*, may be individually coupled to a switch, e.g. 130*a*, to dispense a desired amount of shaving aid 300*a* when activated by the user.

It is also envisioned that the delivery system 60 may include one or a series of interconnected micro-ducts or micro-channels (not shown) (or other types of microfluidics technology) which mix the various shaving aids 300 from reservoirs 62*a*, 62*b* and 62*c* prior to and/or after ejection from the nozzles 68*a*, 68*b*1, 68*b*2 and 68*c*. As can be appreciated, mixing the shaving aids in this manner would provide a more homogenous shaving aid solution for shaving and comfort purposes.

In one embodiment, the switch 130 incorporates a circuit (not shown) which regulates an appropriate amount of shaving aid 300 to be dispensed from a particular reservoir 62*a*–62*c* based upon the desire of an individual user. For example, the user may select a particular switch setting denoted as "sensitive" which will distribute the shaving aid 300 from a reservoir 62*a* with sensitive shaving emollients or mix a combination of shaving aids 300*a*, 300*b*, 300*c* from a plurality of reservoirs 62*a*–62*c* in specific amounts to dispense the shaving aids 300*a*–300*c* onto shaving strips 64*a*–64*c* to provide added protection for sensitive skin. A different user may select another setting, e.g., heavy beard" to achieve a different shaving feel or to release different combinations or amounts of shaving aid 300 from reservoirs 62*a*–62*c*.

FIG. 3B shows another embodiment of the shaving aid delivery system 60 wherein each individual reservoir, e.g., reservoir 62*a*, includes a separate heating element, e.g. 65*a*, which is electrically coupled to a separate switch, e.g. switch 130*a*. The user selectively regulates the amount of shaving aid dispensed from each reservoir upon activation of the switch 130*a*. As mentioned above, the switch, e.g. switch 130*a*, may include a control circuit (not shown) which regulates the expansion of the bubble, e.g., 400*a*, to reduce vaporization of the shaving aid 300*a*. It is also envisioned that the delivery system 60 may include a plurality of nozzles, e.g., 68*b*1 and 68*b*2, disposed within each reservoir, e.g. reservoir 62*b*, to foster uniform distribution of the shaving aid 300*b* across the shaving strip 64 (see FIGS. 3B and 3C).

FIG. 3C shows yet another embodiment of the shaving aid delivery system 60 wherein each reservoir 62*a*, 62*b* and 62*c* is dimensioned to extend across the face 16 of the razor head 12 in a row-like manner, e.g., parallel to the blade members 20*a*, 20*b* and cap member 30. More particularly, reservoir 62*a* is disposed proximate cap member 30, reservoir 62*b* is stacked behind reservoir 62*a* and reservoir 62*c* is stacked behind reservoir 62*b*. As can be appreciated, dimensioning the reservoirs 62*a*–62*c* in this manner fosters uniform distribution of the individual shaving aid 300*a*–300*c* across the shaving surface during the shaving stroke in the direction of arrow "B". A series of nozzles 68*a*, 68*b*, 68*c* may be arranged along each shaving strip 64*a*, 64*b*, 64*c*, respectively, to facilitate uniform distribution of the shaving aids 300*a*, 300*b* and 300*c* across each strip.

The present disclosure also relates to a method of ejecting shaving aid 300 from a razor head 12 and includes the steps of: providing a razor head 12 having: a reservoir 62 for holding a shaving aid 300; a heating element 65 disposed within the reservoir in contact with the shaving aid 300; a shaving strip 64 disposed within the razor head 12 and oriented to engage the skin of a user during a shaving stroke; and an ejection port, e.g., nozzle 68, for directing the shaving aid 300 from the reservoir 62 onto the shaving strip 64. The method also includes the step of selectively activating the heating element 65 to cause rapid volumetric expansion of the shaving aid 300 such that the shaving aid 300 dispenses from the ejection port 68 onto the shaving strip 64.

From the foregoing and with reference to the various figure drawings, those skilled in the art will appreciate that certain modifications can be made to the present disclosure without departing from the scope of the same. For example, while two blades 20*a*, 20*b* are used for illustrative purposes, the razor head may include one, two, three or more blades. Cap member 30 may be segmented into multiple segments in order to eliminate distortion during post-molding shrinkage. At least one of the blades 20*a*, 20*b* may include one or more fencing elements such as the type disclosed in U.S. Pat. Nos. 3,263,330, 3,505,734, 3,750,285 and 4,122,006 which are all hereby incorporated by reference in their entirety herein.

Moreover, it is envisioned that two users may purchase the same shaving system 10 and subsequently select different combinations of shaving aids 300 from any number of reservoirs 62 to provide individualized shaving experiences based upon a particular need, e.g., sensitive skin emollients and/or emollients to soften a heavy beard. It is also contemplated that the shaving aid delivery system 60 may be disposed on other skin engaging surfaces of the razor head 12, e.g., guard bar 40, cap member 30, and/or side walls 15*a*, 15*b*. Alternatively, it is also envisioned that the shaving aid delivery system may be employed without a comfort strip, i.e., shaving aid 300 is issued directly from the reservoir(s) 62 and onto the skin of the user upon activation, e.g., "sprayed" onto the skin.

It is also envisioned that the user may be able to selectively dispense different shaving aids 300 over the course of the shaving process. For example, it is envisioned that the user may be able to initially dispense a particular shaving agent 300*a* from a particular reservoir 62*a* and/or a combination of reservoirs 62*a*, 62*b*, 62*c* to soften the user's beard prior to shaving (in this instance, for example, the user may be able to reverse the shaving stroke (i.e., opposite the intended cutting stroke direction "B" of the blades 20*a*, 20*b*) to simply apply a pre-shave emollient to the skin without cutting). Thereafter, the user may apply subsequent shaving aids 300*b*, 300*c* (or a combination thereof) as needed during the shaving process to achieve a desired shaving sensation, e.g., sensitive shaving aid, after shave emollient, etc.

It is also envisioned that one or more of the reservoirs may include a second port or orifice which enables the reservoir(s) to be refilled with one or more shaving aids. For example, the razor could be sold with a syringe which engages the second orifice and enables the user to refill the reservoir with additional shaving aid(s) as needed.

It is further contemplated that the presently disclosed shaving system may employ microfluidics technology to mix and/or evenly distribute the shaving aid onto the comfort strip. In addition, the shaving strip could be made from a porous or permeable membrane with a unidirectional flow which absorbs the shaving aid for subsequent engagement and issuance to the skin of the user during shaving.

While several embodiments of the disclosure have been described herein, it is not intended that the disclosure be limited thereto, as it is intended that the disclosure be as broad in scope as the art will allow and that the specification be read likewise. Therefore, the above description should not be construed as limiting, but merely as exemplifications of preferred embodiments. Those skilled in the art will envision other modifications within the scope and spirit of the claims appended hereto.

What is claimed is:

1. A shaving aid delivery system for a shaving system, comprising:

a razor head having at least one reservoir for holding a liquid shaving aid, said reservoir being within said razor head;

a shaving strip disposed on said razor head, said shaving strip being oriented to engage the skin of a user during a shaving stroke;

a heating apparatus disposed adjacent to said reservoir;

an actuator coupled to said heating apparatus for initiating volumetric expansion of said shaving aid when actuated; and an ejection port for issuing said shaving aid from said reservoir for distribution through said shaving strip and to the skin of the user upon actuation of said actuator.

2. A shaving aid delivery system according to claim 1 wherein said heating apparatus includes a resistor and an electrical source.

3. A shaving aid delivery system according to claim 2 wherein said resistor is disposed within said reservoir in contact with said shaving aid.

4. A shaving aid delivery system according to claim 1 wherein said shaving strip is segmented.

5. A shaving aid delivery system according to claim 1 wherein said razor head is selectively engageable with a razor handle.

6. A shaving aid delivery system according to claim 5 wherein said actuator is affixed to said razor handle.

7. A shaving aid delivery system according to claim 1 wherein said shaving aid is selected from the group consisting of: silicone oils, Aloe Vera compounds, medicinal agents, cosmetic agents, essential oils, vitamin oils, sunflower oils, sesame oils, Jojoba oils, Allantoin, sodium pyruvates, polyethylene oxides, non-ionic polyacrylamides, polysaccharides, sodium lauryl sulphates, polystyrene compounds and polypropylene compounds, Dimenthicone, Alcohol Benzoates, Glycerin, Cety Alcohol, and Steryl Alcohol.

8. A shaving aid delivery system according to claim 1 further comprising a plurality of ejection ports disposed across said razor head.

9. A shaving aid delivery system according to claim 1 further comprising a plurality of ejection ports disposed across said razor head, each of said ejection ports for directing said shaving aid from said reservoir into contact with a portion of said shaving strip upon activation of said actuator.

* * * * *